United States Patent [19]

Sekiguchi et al.

[11] Patent Number: 4,844,299

[45] Date of Patent: Jul. 4, 1989

[54] FLUID DISCHARGE DEVICE

[75] Inventors: Tomozo Sekiguchi, Kawaguchi; Kazuma Noguchi, Tokyo, both of Japan

[73] Assignee: Pentel Kabushiki Kaisha, Tokyo, Japan

[21] Appl. No.: 168,119

[22] PCT Filed: Jul. 27, 1987

[86] PCT No.: PCT/JP87/00549

§ 371 Date: Jan. 22, 1988

§ 102(e) Date: Jan. 22, 1988

[87] PCT Pub. No.: WO88/00911

PCT Pub. Date: Feb. 11, 1988

[30] Foreign Application Priority Data

Jul. 31, 1986 [JP] Japan ..... 61-117942

[51] Int. Cl.[4] ..... B65D 35/28

[52] U.S. Cl. ..... 222/94; 222/95

[58] Field of Search ..... 222/95, 105, 107, 206, 222/207, 209, 212, 383, 517, 94

[56] References Cited

U.S. PATENT DOCUMENTS

| | | | |
|---|---|---|---|
| 1,704,573 | 3/1929 | Matthews | 222/207 |
| 1,975,545 | 10/1934 | Homewood et al. | 222/207 X |
| 2,557,952 | 6/1951 | Dumont | 222/517 X |

FOREIGN PATENT DOCUMENTS

| | | | |
|---|---|---|---|
| 3432253 | 3/1986 | Fed. Rep. of Germany | 222/95 |
| 42-13648 | 8/1967 | Japan . | |
| 49-2686 | 1/1974 | Japan . | |
| 54-34837 | 10/1979 | Japan . | |
| 58-52231 | 11/1983 | Japan . | |
| 59-8643 | 3/1984 | Japan . | |
| 59-80261 | 5/1984 | Japan . | |
| 59-155978 | 10/1984 | Japan . | |

*Primary Examiner*—Michael S. Huppert

*Attorney, Agent, or Firm*—Wenderoth, Lind & Ponack

[57] ABSTRACT

A fluid discharge device has a fixed member provided with a hollow cylindrical piston having a normally-closed valve on its upper surface, a press member provided with a hollow cylinder which has a normally-closed valve on its upper surface, and which is fitted slidably around the piston, and a storage chamber formed of a soft material, secured to the lower portion of the fixed member and holding fluid therein. The press member is constantly urged upward by a resilient member provided between the press member and the fixed member, to thereby enable the press member to be pressed down freely. The fluid in the storage chamber is discharged to the upper surface of the press member by pressing the press member in the downward direction, and thereafter releasing the press member.

6 Claims, 2 Drawing Sheets

FLUID DISCHARGE DEVICE

BACKGROUND OF THE INVENTION

1. Field of the Invention

This invention relates to a fluid discharge device which permits various kinds of viscous fluids to be held in a storage chamber formed of a soft material and discharged efficiently, and more particularly to a fluid discharge a predetermined quantity of device capable of discharging fluid reliably from a storage chamber. The present invention is operable under a simple pressing operation, does not have a complicated structure so as to be manufacturable with high productivity and at a low cost and can be housed in containers having various shapes.

The fluid discharge device according to the present invention is suitably used for, especially discharging, cosmetics, such as foundation, lip color, cream and cosmetic liquids, and can also be used to discharge various kinds of viscous fluids, such as paste and paint, and mustard.

2. Description of the Related Art

Japanese Utility Model Publication No. 42-13648 published in 1967 discloses a fluid discharge device of the type described above. The fluid discharge device disclosed in this publication has a quantitative suction chamber at an opening of a flexible container, in which fluid is held, a check valve provided between the passage and the quantitative suction chamber and adapted to be opened only toward the quantitative suction chamber, a ball which is provided in an extraction port formed on a side wall of the quantitative suction chamber, and which is adapted to be urged toward the quantitative suction chamber by a spring, and a piston provided at a corner of the quantitative suction chamber and adapted to be spring-biased by a spring. When the piston is pressed against the resilient force of the spring, the valve is closed by fluid held in the quantitative suction chamber, and the ball is pressed at the same time, so that the fluid can be discharged through an outlet port. When the piston is returned under the resilient force of the spring, the valve is opened by negative pressure with the outlet port kept closed by the ball, to enable fluid to be introduced again into the quantitative suction chamber while contracting the flexible container.

Therefore, according to the conventional liquid discharge device, the fluid can be sucked from the flexible container and discharged by reciprocating the piston. This enables the fluid in the flexible container to be used up most efficiently.

However, in the above-mentioned conventional device, the operating valve used to suck and discharge the fluid, and the piston means including the ball have a complicated structure, and this contributes to a relatively low productivity associated with the manufacture of the device and consequently to a relatively high price thereof. Since the piston mechanism having a complicated structure as mentioned above is joined to the flexible container in the opening thereof, the length and volume of the fluid discharge device as a whole is relatively high, and the shape of the device is limited. Therefore, this fluid discharge device cannot be applied to containers having various shapes including a miniaturized container and a flat container.

SUMMARY OF THE INVENTION

A primary object of the present invention is to provide a fluid discharge device which is free from the drawbacks of the prior art fluid discharge device.

Another object of the present invention is to provide a fluid discharge device capable of discharging a predetermined quantity of fluid from a fluid storage chambr in a reliable manner by performing a simple pressing operation.

Still another object of the present invention is to provide a fluid discharge device which does not have a complicated structure, can be made with high productivity and at a low cost and can be housed in containers having various shapes.

The fluid discharge device according to the present invention comprises a fixed member provided with a hollow, cylindrical piston having a normally-closed check valve on its upper surface, a press member provided with a hollow cylinder which has a normally-closed check valve on its upper surface, and which is fitted slidably around the piston, and a storage chamber comprising soft material, secured to the lower portion of the fixed member and holding a fluid therein, the press member being urged upward constantly by a resilient member provided between the press member and fixed member, to thereby enable the press member to be pressed down freely.

DETAILED DESCRIPTION OF THE PREFERRED EMBODIMENTS

Figure 1:
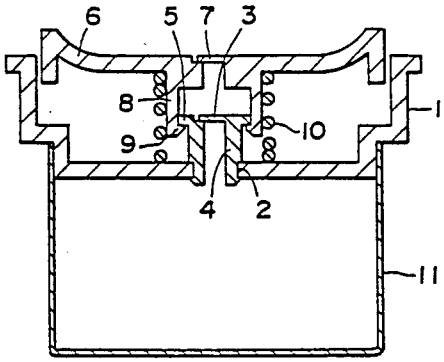
FIG. 1 is a sectional view of a first embodiment of the fluid discharge device according to the present invention.

In FIG. 1, a fixed member 1 has a hole 2 in which a hollow, cylindrical piston 4 is disposed which has a normally-closed check valve 3 on its upper surface, and which is formed integrally with or separately from the fixed member 1. A press member 6 is provided with an integrally formed hollow cylinder 8 which has a normally-closed check valve 7 on its upper surface, and which is fitted slidably around the piston. An outward projection 5 is formed on the outer surface of the upper protion of the piston 4 disposed in the fixed member 1. An inward projection 9 is formed on the inner surface of the lower end portion of the cylinder 8 and is adapted to be engaged with the outward projection 5 and thereby prevent the press member 6 from coming off in the upward direction. As illustrated, a stepped portion is formed on the inner surface of the fixed member 1, and the outer circumferential portion of the press member 6 is engaged with the stepped portion.

A resilient member 10 such as a helical spring is provided between the press member 6 and the fixed member 1, and the press member 6 is urged upward by the spring 10 so that the press member 6 can be pressed down against a resilient force exerted by the spring 10.

A storage chamber 11 holds a predetermined viscous fluid such as a cosmetic fluid or a writing fluid. The storage chamber 11 is formed of a soft material, such as a synthetic resin film or a metal film, which can be contracted as the fluid held therein is consumed, and the storage chamber 11 communicates with the piston 4 disposed in the fixed member 1. In order to secure the storage chamber 11 to the fixed member 1, a thermal fusion method or a clamping method using a ring can be used when the walls of the storage chamber 11 are thin, and a direct screwing method or a press-fitting method can be used when the walls of the storage chamber 11 are thick as in a blow-molded container. The storage chamber 11 may also be secured at the opening at the lower end of the piston 4 in the fixed member 1 instead of the fixed member 1 itself.

Figure 2:
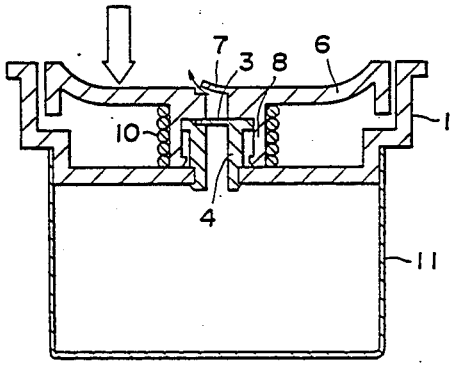
FIGS. 2 and 3 illsutrate the operation of the embodiment of FIG. 1.

A fluid discharging operation of the above-described embodiment will now be described with reference to FIGS. 2 and 3.

In order to discharge the fluid held in the storage chamber 11 to the upper surface of the press member 6, the press member 6 while at the position shown in FIG. 1 is pressed down against the resilient force exerted by the spring 10. Consequently, the cylinder 8 of the press member 6 is also displaced downward with respect to the piston 4. During this time, the valve 3 in the piston 4 is closed. Accordingly, if the fluid is held in the cylinder 8, the fluid is pressurized due to the downward movement of the cylinder 8 to cause the valve 7 in the cylinder 8 to be pressed and opened, so that the fluid is discharged to the upper surface of the press member 6 as shown by the small arrow in FIG. 2.

Figure 3:
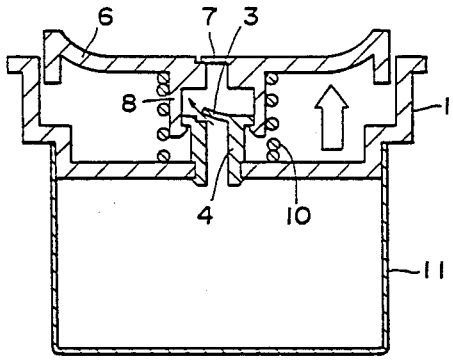

When the pressing force is then removed from the press member 6, the press member 6 and cylinder 8 are retracted by the resilient force exerted by the spring 10 to the position shown in FIG. 3. During this step, the pressure in the interior of the cylinder 8 becomes negative due to the upward movement of the cylinder 8. Accordingly, the valve 7, which is opened in the above-mentioned pressing step, in the cylinder 8 is closed, while the valve 3, which is closed in the above-mentioned step, in the piston 4 is pressed and opened by fluid flowing from the storage chamber 11 to the interior of the piston 4. Consequently, the cylinder 8 is again filled with fluid as shown by the arrow in FIG. 3. Since the storage chamber 11 contracts as the fluid held therein is consumed, the fluid can be entirely discharged without waste.

Thus, when the press member 6 is pressed down, the fluid held in the cylinder 8 can be discharged to the upper surface of the press member 6, and, when the pressing force is removed from the press member 6, the cylinder 8 can be filled with fluid again. Therefore, the fluid held in the storage chamber 11 can be discharged in suitable predetermined quantities.

Figure 4:
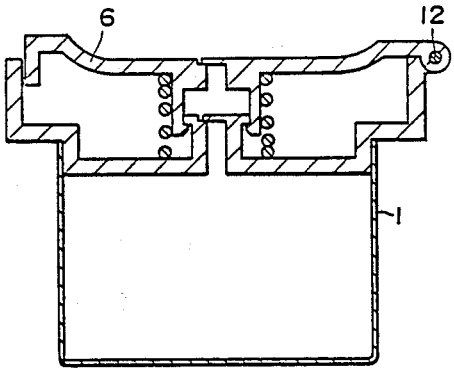
FIG. 4 is a sectional view of a second embodiment of the present invention.

FIG. 4 shows a second embodiment of the present invention, which is different from the first embodiment in that one end portion of a fixed member 1 and a corresponding portion of a press member 6 are joined together pivotably with a pin 12 to thereby render the press member 6 capable of being pressed down around a fulcrum consisting of the pivotable joint portion. In the embodiment of FIG. 4, the operation of the press member 6 can be stably carried out. This enables the discharging of a suitable quantity of fluid in a more reliable manner.

Figure 5:
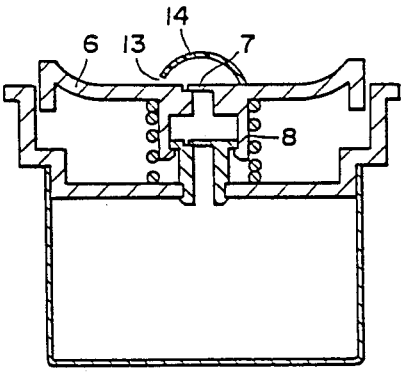
FIG. 5 is a sectional view of a third embodiment of the present invention.

FIG. 5 shows a third embodiment of the present invention, which is different from the first embodiment in that a dome-like hood 14 having a guide outlet 13 is provided over a valve 7 in a cylinder 8 formed on the inner surface of a press member 6. In the embodiment of FIG. 5, the upper surface of the hood 14 can be pressed, so that the central portion of the press member 6 which is just above the cylinder 8 can be pressed down. Accordingly, a suitable quantity of the fluid can be discharged more reliably. In the embodiment of FIG. 5, the fluid pressure through the valve 7, and is then discharged to the upper surface of the press member 6 via the guide outlet 13 of the hood 14.

Figure 6:
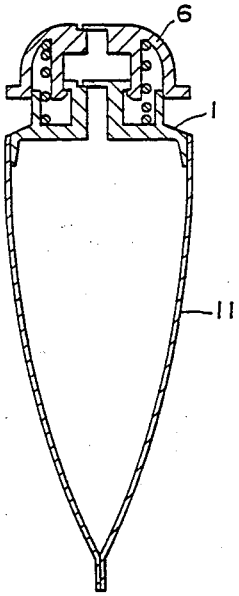
FIG. 6 is a sectional view of a fourth embodiment of the present invention.

FIG. 6 shows a fourth embodiment of the present invention, which is different from the first embodiment in that a press member 6 and a fixed member 1 are miniaturized and used with a collapsible storage chamber 11 which can be flattened.

Figure 7:
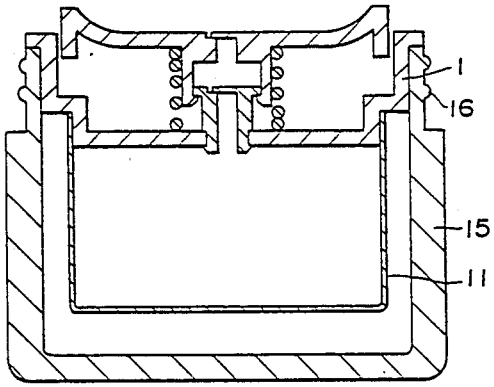
FIG. 7 is a sectional view of a fifth embodiment of the present invention.

FIG. 7 shows a fifth embodiment of the present invention, which is different from the first embodiment in that a fixed member 1, to which a storage chamber 11 is secured, is fixedly mounted in a container 15. Referring to the drawing, reference numeral 16 denotes a locking projection provided so that a cap or cover (not shown) can be engaged therewith.

According to the present invention, a fluid discharge device having a simple structure can be manufactured at a low cost, can be adapted for use with containers having various shapes and is capable of discharging predetermined quantities of the fluid, which is held in a storage chamber, by performing a very simple operation.

The above-described fluid discharge devices are the preferred embodiments of the present invention, and the present invention is not limited to the illustrated embodiments. For example, a guide groove which is used when the press member 6 is pressed down may be provided in the inner surface of the fixed member 1. The present invention can not only be adapted for use with the container in the embodiment of FIG. 7 but also for use with containers having various other shapes. It may be understood that the present invention can be changed partially and modified in various manners within the scope of the claims.

What is claimed is:

1. A fluid discharging device comprising:

a storage chamber comprising soft material for containing fluid;

a fixed member fixed in the device, said fixed member including a lower portion to which said storage chamber is secured, and a cylindrical piston extending from said lower portion in a direction away from said storage chamber, said cylindrical piston having a first end open to said storage chamber and a second end defining an upper surface;

a first one-way valve disposed at the upper surface of said cylindrical piston and normally closing the second end of said piston, said first one-way valve movable in a direction away from said storage chamber to open the second end of said piston;

a press member disposed opposite said storage chamber with respect to said lower portion and movable in the device relative to said fixed member, said press member including a cylindrical portion having a first end disposed around and slidable along said cylindrical piston at the exterior of said storage chamber and a second end defining an upper surface spaced from the upper surface defined by the second end of said piston;

the cylindrical portion of said press member and the upper surface of said piston defining a suction chamber;

a second one-way valve disposed at the upper surface of said cylindrical portion and normally closing said suction chamber to the exterior of the device, said second one-way valve movable in a direction away from said suction chamber to open said suction chamber to the exterior of said device; and a resilient spring disposed around said piston and said cylindrical portion outside of said storage chamber and between said fixed member and said press member, said resilient spring biasing said press member away from said fixed member.

2. A fluid discharging device as claimed in claim 1, wherein said first one-way valve comprises a flap integral with said cylindrical piston, and said second one-way valve comprises a flap integral with said cylindrical portion.

3. A fluid discharging device as claimed in claim 1, wherein said press member is pivotably mounted to said fixed member.

4. A fluid discharging device as claimed in claim 1, and further comprising a hood extending over the upper surface of said cylindrical portion and covering said second one-way valve, said hood having an outlet through which fluid passing through said second one-way valve is dischargeable.

5. A fluid discharging device as claimed in claim 1, wherein said storage chamber is collapsible.

6. A fluid discharging device as claimed in claim 1, and further comprising a container, said storage chamber being mounted to said container and disposed therein.

* * * * *